United States Patent [19]

MacGregor et al.

[11] Patent Number: 4,506,793

[45] Date of Patent: Mar. 26, 1985

[54] BREAKABLE VIAL

[75] Inventors: David C. MacGregor; Gary S. Margules, both of Miami, Fla.

[73] Assignee: Cordis Corporation, Miami, Fla.

[21] Appl. No.: 519,202

[22] Filed: Aug. 1, 1983

[51] Int. Cl.[3] ..... B65D 17/32

[52] U.S. Cl. ..... 215/32

[58] Field of Search ..... 215/32, 33, 34, 35, 215/36

[56] References Cited

U.S. PATENT DOCUMENTS

| | | | |
|---|---|---|---|
| 599.711 | 3/1898 | Kievit | 215/34 |
| 2,072,701 | 3/1937 | Barlow | 215/33 |
| 2,628,615 | 2/1953 | Saffir . | |
| 2,908,555 | 10/1959 | Grosskopf . | |
| 3,720,341 | 3/1973 | Greenfield et al. | 215/32 X |
| 3,749,271 | 7/1973 | Ellis et al. | 215/32 |
| 3,945,383 | 3/1976 | Bennett et al. . | |
| 4,130,117 | 12/1978 | Van Eck . | |
| 4,155,454 | 5/1979 | Ryden | 206/532 |

*Primary Examiner*—Donald F. Norton

*Attorney, Agent, or Firm*—Lockwood, Alex, FitzGibbon & Cummings

[57] ABSTRACT

An elongate vial of glass or other breakable material includes upper and lower portions which are separated by a weakened portion to facilitate breaking of the vial at the weakened portion. Flexible sleeves surround the upper and lower portions of the vial adjacent the weakened portion and cover the weakened portion. The sleeves are deformable across the break in the portions of the vial when the vial is broken to minimize injury to persons who come into contact with the broken vial and damage to a catheter which might be inserted into the vial. The deformed portion of the sleeve which remains on the lower portion of the vial defines an opening to permit access to the contents of the lower portion of the vial.

28 Claims, 5 Drawing Figures

BREAKABLE VIAL

BACKGROUND AND SUMMARY OF THE INVENTION

The present invention relates to a vial and, more particularly, to the safe opening of such vial.

Medicinals, chemicals and other materials in liquid, suspended or powder form are frequently stored and preserved in sealed vials of glass or other breakable materials. At the time the contents of the vial are to be used, the vial is broken to gain access to its contents. Controlled breaking of the vial is usually accomplished by a narrow, circumferential weakened region about the vial. Such weakened region may be formed by a deformation of the vial material and/or a scoreline which may be mechanically formed onto the circumference of the vial by means such as filing, and in which the thickness of the wall of the vial is reduced at the preselected location to weaken the vial material in the region where it is desired to break the vial.

Although such sealed vials have the advantage of protecting the contents of the vial against contamination, tampering or loss, the aforementioned manner of opening the vial by breaking does have several disadvantages. Breaking of the vial may result in the inadvertent shattering of the glass or other breakable material at or adjacent to the site at which the vial is broken so as to result in small fragments of broken material which may be scattered in the surrounding environment or may contaminate the contents of the vial itself. Such broken particles produce a potential hazard of cutting or becoming embedded in the skin or eyes of the user, a patient who may be anesthetized, or other persons in the immediate vicinity. Moreover, after the vial is broken, sharp edges or broken fragments may be present on the broken edge of the vial resulting in a personnel hazard during use and disposal of the vial. Such sharp edges may also result in damage to a catheter, tube or other device which is to be placed into the contents of the vial.

A vial incorporating the principles of the present invention minimizes the aforementioned disadvantages. In a vial incorporating the principles of the present invention, a flexible sleeve or sleeves on the vial minimize, contain and control broken fragments of the vial during and after breaking of the vial. Once the vial is broken, the sleeve or sleeves deform to cover the sharp edges of the broken vial and trap broken glass particles to minimize personnel hazard and preclude damage to a catheter, tube or other device which may be inserted in the vial. Such deformed sleeve may also function to provide a seal about the catheter or tube to reduce the possibility of spillage or contamination of the vial contents.

In one principal aspect of the present invention, a hollow, breakable, sealed vial having upper and lower portions separated by a weakened region to facilitate the breaking of the vial at the weakened region includes a flexible sleeve surrounding the upper and lower portions of the vial adjacent to and covering the weakened region. A part of the sleeve is deformable toward the longitudinal axis of the vial when the vial is broken and the upper portion is removed to cover the broken edge of the vial.

In another principal aspect of the present invention, a pair of such flexible sleeves are provided. One of the sleeves surrounds the upper and lower portions of the vial adjacent to and covering the weakened region. The other of the sleeves surrounds a portion of the vial and at least a part of the one sleeve. Both of the sleeves are deformable toward the longitudinal axis of the vial when the vial is broken and the upper portion of the vial is removed to cover the broken edges of the upper and lower portions of the vial.

In still another principal aspect of the present invention, a part of the sleeve surrounding the upper portion of the vial deforms across the lower portion of the vial when the vial is broken at the weakened region and the upper portion is removed.

In still another principal aspect of the present invention, the deformed part of the last mentioned sleeve defines an opening which is of lesser width than the width of the vial at its weakened region.

In still another principal aspect of the present invention, the last mentioned deformed part of the sleeve defines a seal about a catheter when the catheter is inserted into the lower portion of the vial.

In still another principal aspect of the present invention, at least a part of the sleeve surrounding the lower portion of the vial is bonded and/or stretched over the lower portion.

In still another principal aspect of the present invention, either or both of the aforementioned sleeves are a molded elastomeric material and the part of the sleeve which is deformed returns substantially to its molded shape when the vial is broken to cover the broken edge of the vial.

In still another principal aspect of the present invention, means is included on one or both of the sleeves into which broken fragments of the vial may become embedded when the vial is broken.

In still another principal aspect of the present invention, the last mentioned means comprises a viscoelastic material on the sleeve.

In still another principal aspect of the present invention, the sleeve includes fibers or wires.

These and other objects, features and advantages of the present invention will be clearly understood through a consideration of the following detailed description.

BRIEF DESCRIPTION OF THE DRAWING

In the course of this description, reference will frequently be made to the attached drawing in which.

DESCRIPTION OF THE PREFERRED EMBODIMENTS

Preferred embodiments of vial 10 and manner of opening of the vial are shown in FIGS. 1–4.

Figure 1:
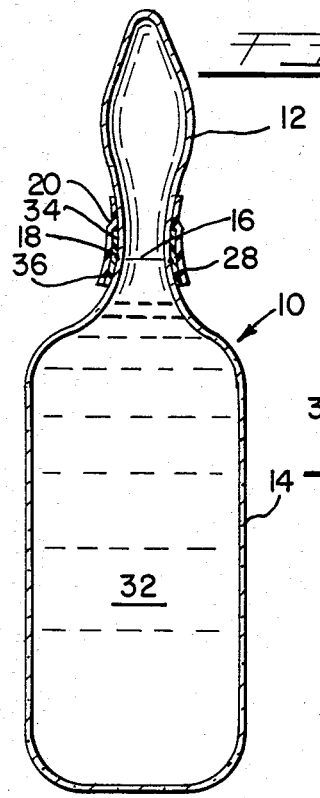
FIG. 1 is a cross-sectioned elevation view of a vial in accordance with the principles of the present invention and before breaking.
Figure 2:
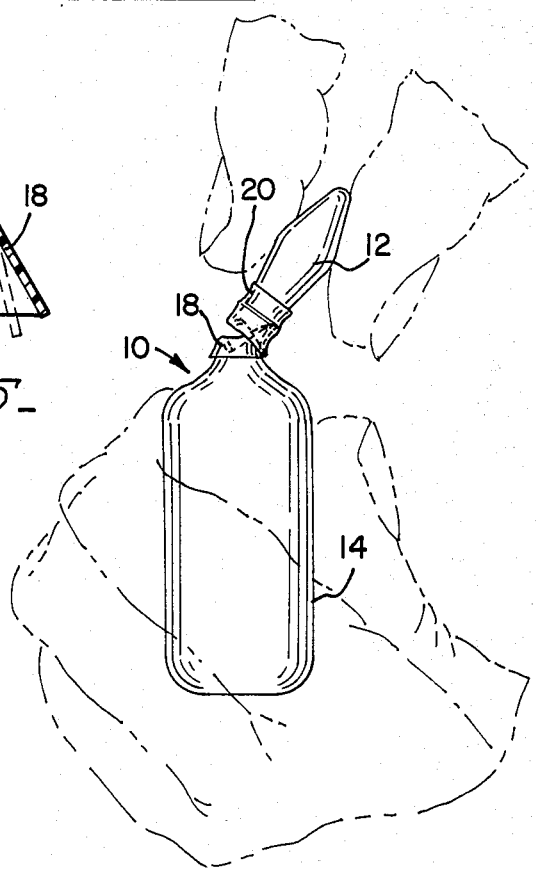
FIG. 2 is an elevation view of the vial shown in FIG. 1, but in the process of being broken.

The vial 10, as shown, comprises a hollow, sealed container having an upper portion 12 and a bulbous lower portion 14. The vial 10 is preferably formed of a suitable, inert breakable material, such as glass. The upper portion 12 and lower portion 14 are joined together at a weakened region 16, as seen in FIG. 1. The weakened region 16 may be formed in any one of a number of well-known ways. For example, the weakened region may be formed by a deformed portion of the vial wall and/or it may be formed by a circumferential line of reduced thickness by filing a circumferential scribe as shown in FIG. 1. The purpose of the weakened region 16 is to control the location at which the vial breaks when the vial is abruptly angulated, as shown in FIG. 2.

Figure 5:
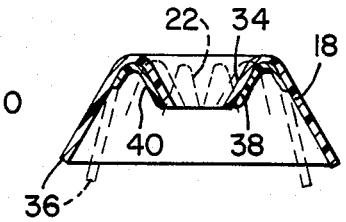
FIG. 5 is an enlarged elevation view of a preferred embodiment of sleeve for the lower portion of the vial.

In the preferred form of the invention, a pair of flexible sleeves 18 and 20 are positioned in closely fitting surrounding relationship to the upper and lower portions 12 and 14 of the vial, as shown in FIG. 1. One or both of these sleeves may be formed of a suitable elastomeric material, such as rubber or polymeric material, or may be formed of a fabric or a combination thereof. As best shown in FIG. 5, one or both of the sleeves may also have fibers or short lengths of wire 22 embedded therein for a purpose to be described to follow. The lower sleeve 18 surrounds the vial at the weakened region 16 and overlies both the upper and lower portions 12 and 14 at least adjacent the weakened region. The upper sleeve 20 also surrounds the vial at the weakened region 16 and overlies the upper portion 12 of the vial and at least a portion of the lower sleeve 18 adjacent the weakened region. It will be understood that the sleeves may also be reversed with the lower sleeve 18 overlying the upper sleeve 20.

Figure 3:
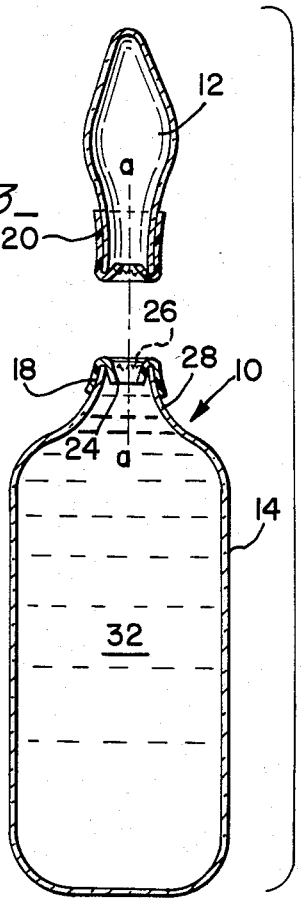
FIG. 3 is a cross-sectioned elevation view of the upper and lower portions of the vial after breaking.
Figure 4:
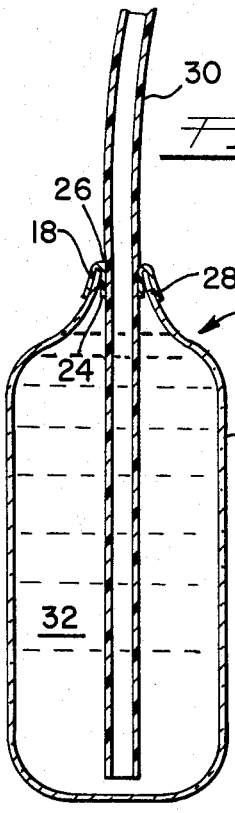
FIG. 4 is a cross-sectioned elevation view of the lower portion of the vial, as shown in FIG. 3, but in which a catheter has been inserted into the contents of the vial.

An important feature of the present invention is that parts of at least one, and preferably both of the sleeves 18 and 20 are also capable of deforming toward the longitudinal axis a of the vial, as shown in FIG. 3, when the vial has been broken and the upper portion 12 has been removed. The lower deformed part of sleeve 18 also preferably defines an opening 24, as shown in FIGS. 3 and 4, which is of lesser width than the width of the opening 26 in the neck 28 of the lower portion 14 of the vial and the sleeve is deformed across that opening in the lower portion of the vial. This deformed part of the sleeve not only covers the broken edge at the opening 26 of the lower portion of the vial to protect against injury to personnel, but also may form a seal through which a catheter 30 may be inserted into the contents 32 of the vial as shown in FIG. 4. The deformed seal sleeve prevents damage to the catheter from the sharp edge at the opening 26 and also seals the catheter to minimize spillage or loss of the contents 32 after the catheter has been inserted into the lower portion of the vial. The lower part of the upper sleeve 20 also deforms inwardly to cover the broken edge of the upper portion 12 of the vial to protect against personnel injury.

The flexible sleeves 18 and 20 may be applied to the vial as elastic bands, as preformed coverings or as coatings which may be applied by a variety of techniques, such as painting, spraying or dip coating. The sleeves 18 and 20 may also be bonded to the lower and upper portions, respectively, of the vial where they are in contact with the vial to protect against their inadvertent removal upon breaking of the vial and to hold them in position in surrounding overlying relationship to the weakened region 16.

The sleeves 18 and 20 are preferably formed of an elastomeric polymer which has a memory, such as silicone rubber or polyurethane. The sleeves are preferably molded, prior to installation on the vial, into a shape which will enable them to be installed on the vial, after molding, but will deform substantially to their originally molded shape upon breaking of the vial.

By way of example and with particular reference to FIG. 5, the lower sleeve 18 is shown in both its post-molding, pre-installation shape and the shape that it assumes after it is installed on the vial and after the vial is broken.

After molding and before installation upon the vial, the sleeve 18 assumes a natural shape in which the upper part 34 of the sleeve which is to surround the lower part of the upper portion 12 of the vial is deformed inwardly, as shown in FIG. 5, and the lower part 36 of the sleeve, which is to surround the upper part of the lower portion 14 of the vial, extends downwardly, as shown in dot and dash in FIG. 5.

When the molded sleeve 18 is to be installed on the unbroken vial, it may be stretched and radially expanded so that it can be slid down over the upper portion 12 of the vial until it is positioned over the weakened region 16 as shown in FIG. 1. Such stretching and expansion of the sleeve may be assisted by treating the sleeve with a suitable volatile solvent, such as heptane, in a known manner.

Once the sleeve 18 is positioned on the vial, the lower part 36 of the sleeve will be stretched outwardly, as shown in FIG. 5, to assume the shape of the neck 28 of the vial and will elastically grip the neck due to such stretching. If desired, the lower part 36 of the sleeve may also be adhesively bonded to the neck 28 to insure that the sleeve will not become separated from the lower portion 14 of the vial when the vial is broken. The upper part 34 of the sleeve will also be stretched inside out, upwardly so that its underside 38, as shown in FIG. 5, fits about and contacts the lower part of the upper portion 12 of the vial just above the weakened region 16. However, the upper part 34 of the sleeve will still retain its memory of the inwardly deformed shape in which it was molded.

Although the post-molded, pre-installation shape of the upper sleeve 20 is not shown, it will be understood that such shape will be generally as shown in its deformed condition in FIG. 3, except that its upper part is stretched somewhat to grip the upper portion 12 of the vial, as shown in FIG. 3, and in the manner previously described with respect to the lower sleeve 18. Upper sleeve 20 is installed in a manner similar to the sleeve 18 after the latter sleeve has been installed and its upper stretched part may also be adhesively bonded to the upper portion 12 of the vial as previously described with respect to the lower sleeve 18.

When the vial is broken along the weakened region 16, as shown in FIG. 2, the upper part 34 of the lower sleeve 18 and the lower part of the upper sleeve 20 will substantially return to their original molded shapes, as shown in FIGS. 3 and 5, due to the memory in the sleeve material. Thereby, the sleeves 18 and 20 will cover the jagged broken edges of the lower and upper portions 14 and 12, respectively, of the vial to protect against cutting and trap flying particles of glass.

It may also be desirable to form one or both of the sleeves 18 and 20 adjacent the weakened region 16 so that any loose particles of glass will become embedded in the sleeves and, thereby,. entrap these potentially injurious particles in the sleeve material. By way of example, one preferred manner of accomplishing this is illustrated in FIG. 5 in which a layer 40 of a viscoelastic material, such as a silicone gum from which some or all of the silica filler which may otherwise be present in the material in sleeve 18, has been omitted. Such viscoelastic gum layer 40 will trap the fragments upon breaking of the vial, but the remaining silica filled silicone polymer will insure that sufficient memory is present in the sleeve so that it will substantially return to its molded shape. Although the viscoelastic material is only shown on the lower sleeve 18 in FIG. 5, it will be understood that the viscoelastic material layer may also be employed on the upper sleeve 20.

As previously mentioned, fibers or wires 22 may also be associated with or embedded in one or both of the sleeves 18 and 20, as shown in FIG. 5. These fibers or wires 22 are preferably stiffer and have a higher elastic limit and greater resiliency than the elastomeric material from which the sleeve is formed. As such they will assist the sleeves to return to their original remembered molded shape when the vial is broken.

It will be understood that although a premolded form of sleeve has been disclosed, other mechanisms which will cause inward deformation of the sleeve upon breaking of the vial may be employed without departing from the principles of the invention. Embedding of the fragments may also be accomplished by employing a highly porous, soft material in the sleeves in lieu of or together with the viscoelastic material 40.

It will also be understood that the embodiments of the present invention which have been described are merely illustrative of a few of the applications of the principles of the present invention. Numerous modifications may be made by those skilled in the art without departing from the true spirit and scope of the invention.

What is claimed is:

1. A hollow, breakable, sealed vial having upper and lower portions separated by a weakened region to facilitate the breaking of the vial at said weakened region, the improvement therein comprising:

flexible sleeve means surrounding said upper and lower portions of said vial adjacent to and covering said weakened region, a part of said sleeve means being deformable toward the longitudinal axis of the vial when the vial is broken and the upper portion is removed, said flexible sleeve means being constructed to remain so deformed to cover the broken edge of said upper portion of the vial.

2. The vial of claim 1, wherein the part of said sleeve means surrounding the upper portion of said vial also deforms across the lower portion of the vial when the vial is broken at the weakened region and the upper portion is removed.

3. The vial of claim 2, wherein the last mentioned deformed part of said sleeve means defines an opening which is of lesser width than the width of the vial at its weakened region.

4. The vial of claim 3, wherein the last mentioned deformed part of said sleeve means defines a seal about a catheter when the catheter is inserted into the lower portion of the vial.

5. The vial of claim 1, wherein at least a part of said sleeve means surrounding said lower portion of said vial is bonded thereto.

6. The vial of claim 1, wherein at least a part of said sleeve means surrounding said lower portion of said vial is stretched over said lower portion.

7. The vial of claim 1, wherein said sleeve means is a molded elastomeric material and said part of said sleeve means which is deformed returns substantially to its molded shape when the vial is broken to cover the broken edge of the vial.

8. The vial of claim 7, including means on said sleeve means into which broken fragments of said vial may become embedded when said vial is broken.

9. The vial of claim 8, wherein said means into which fragments are embedded comprises a viscoelastic material on said sleeve means.

10. The vial of claim 1, including means on said sleeve means into which broken fragments of said vial may become embedded when said vial is broken.

11. The vial of claim 10, wherein said means into which fragments are embedded comprises a viscoelastic material on said sleeve means.

12. The vial of claim 1, wherein said sleeve means includes fibers or wires.

13. The vial of claim 1 wherein said sleeve means comprises a pair of flexible sleeves, one of said sleeves surrounding said upper and lower portions of said vial adjacent to and covering said weakened region and the other of said sleeves surrounding a portion of said vial and at least a part of said one sleeve, and both of said sleeves are deformable toward the longitudinal axis of the vial when the vial is broken and the upper portion of the vial is removed to cover the broken edges of the upper and lower portions of the vial.

14. The vial of claim 13, wherein said deformed part of said sleeve which covers the broken edge of said lower portion of the vial defines an opening which is of lesser width than the width of the vial at its weakened region.

15. The vial of claim 14, wherein said last mentioned deformed part of said sleeve defines a seal about a catheter when the catheter is inserted into the lower portion of the vial.

16. The vial of claim 13, wherein at least a part of at least one of said sleeves which surrounds said vial is bonded thereto.

17. The vial of claim 13, wherein at least a part of at least one of said sleeves which surrounds said vial is stretched over said vial.

18. The vial of claim 13, wherein said sleeves are a molded elastomeric material and said part of said sleeves which is deformed returns substantially to its molded shape when the vial is broken to cover the broken edges of the vial.

19. The vial of claim 18, including means on at least one of said sleeves into which broken fragments of said vial may become embedded when said vial is broken.

20. The vial of claim 19, wherein said last mentioned means comprises a viscoelastic material on said sleeve.

21. The vial of claim 13, including means on at least one of said sleeves into which broken fragments of said vial may become embedded when said vial is broken.

22. The vial of claim 21, wherein said last mentioned means comprises a viscoelastic material on said sleeve.

23. The vial of claim 13, wherein at least one of said sleeves includes fibers or wires.

24. A hollow, breakable, sealed vial having upper and lower portions separated by a weakened region to facilitate the breaking of the vial at said weakened region, comprising:

a flexible sleeve surrounding said upper and lower portions of said vial adjacent to and covering said weakened region, a part of said sleeve being deformable toward the longitudinal axis of the vial when the vial is broken and the upper portion is removed to cover the broken edge on at least one of the portions of the vial, said sleeve being a molded elastomeric material and said part of said sleeve which is deformed returns substantially to its molded shape toward the longitudinal axis when the vial is broken to cover the broken edge of the vial, and said sleeve being specially constructed to provide for embedding of broken fragments of said vial therein when said vial is broken.

25. The vial of claim 24, wherein said last mentioned means comprises a viscoelastic material on said sleeve.

26. A hollow, breakable, sealed vial having upper and lower portions separated by a weakened region to facilitate the breaking of the vial at said weakened region, comprising:

a flexible sleeve surrounding said upper and lower portions of said vial adjacent to and covering said weakened region, a part of said sleeve being deformable toward the longitudinal axis of the vial when the vial is broken and the upper portion is removed, said flexible sleeve means being constructed to remain so deformed to cover the broken edge on at least one of the portions of the vial, said sleeve being specially constructed to provide for embedding of broken fragments of said vial therein when said vial is broken.

27. The vial of claim 26, wherein said last mentioned means comprises a viscoelastic material on said sleeve.

28. A hollow, breakable, sealed vial having upper and lower portions separated by a weakened region to facilitate the breaking of the vial at said weakened region, comprising:

a flexible sleeve surrounding said upper and lower portions of said vial adjacent to and covering said weakened region, a part of said sleeve including fibers or wires therein for deforming said part toward the longitudinal axis of the vial when the vial is broken and the upper portion is removed to cover the broken edge on at least one of the portions of the vial.

* * * * *